US009877550B1

(12) United States Patent
Chen

(10) Patent No.: US 9,877,550 B1
(45) Date of Patent: Jan. 30, 2018

(54) ONE-PIECE PULL TAB

(71) Applicant: Duraflex Hong Kong Limited, Sheung Wan (HK)

(72) Inventor: Te Chien Chen, Tsuen Wan (HK)

(73) Assignee: Duraflex Hong Kong Limited, Sheung Wan (HK)

( * ) Notice: Subject to any disclaimer, the term of this patent is extended or adjusted under 35 U.S.C. 154(b) by 0 days.

(21) Appl. No.: 15/397,963

(22) Filed: Jan. 4, 2017

(51) Int. Cl.
*A44B 19/26* (2006.01)
*A44B 19/42* (2006.01)

(52) U.S. Cl.
CPC ..... *A44B 19/262* (2013.01); *A44B 19/42* (2013.01)

(58) Field of Classification Search
CPC ..... A44B 19/262; A44B 19/42
See application file for complete search history.

(56) References Cited

U.S. PATENT DOCUMENTS 3,146,012 A 8/1964 King, Sr.
3,290,080 A 12/1966 Dawson
3,712,655 A 1/1973 Fuehrer
3,831,474 A 8/1974 Perlman
3,975,040 A 8/1976 Van Gompel
4,093,288 A 6/1978 Suzuki
4,106,802 A 8/1978 Lozio
4,240,183 A 12/1980 Sumimoto et al.
4,245,374 A 1/1981 Suzuki
4,299,417 A * 11/1981 McClure ..... G09F 3/0358 292/320
4,532,679 A 8/1985 Scott
4,580,319 A 4/1986 Paradis
4,609,218 A 9/1986 Chevillard
4,636,347 A 1/1987 Kato
5,347,692 A 9/1994 Ebata
5,416,951 A 5/1995 Keyaki et al.
5,535,491 A 7/1996 Allport
5,632,076 A 5/1997 Ervin et al.
5,860,192 A 1/1999 Chung
(Continued)

FOREIGN PATENT DOCUMENTS

WO 2011/139546 A1 11/2011

OTHER PUBLICATIONS

International Search Report and Written Opinion of the International Searching Authority of PCT/CN2015/083014, dated Oct. 13, 2015.

*Primary Examiner* — Robert Sandy
*Assistant Examiner* — Rowland Do
(74) *Attorney, Agent, or Firm* — Collard & Roe, P.C.

(57) ABSTRACT

A pull tab is formed by a cord having a cord retaining member at one end and a plug at the other end. The plug has a flap connected to one end, the flap having an open position where the flap is connected to the plug only at one end of the flap, and a closed position where the entire flap is secured to the plug. The cord retaining member has first and second channels therethrough, with the second channel being larger than the first channel. When the flap is open, the plug fits though both the first and second channels, and when the flap is closed, the plug fits only within the second channel. The pull tab is assembled by feeding the plug through the channels, moving the flap to the closed position and pulling the plug back through the second channel until the plug is seated in the second channel.

6 Claims, 2 Drawing Sheets

(56) References Cited

U.S. PATENT DOCUMENTS

| | | | | |
|---|---|---|---|---|
| 6,058,578 | A * | 5/2000 | Lan | A44B 19/262 24/115 G |
| 6,073,319 | A | 6/2000 | Silagy | |
| 6,098,253 | A * | 8/2000 | Nishida | G09F 3/0352 24/16 PB |
| 6,321,434 | B1 | 11/2001 | Kubota | |
| 6,415,482 | B1 * | 7/2002 | Pontaoe | A44B 19/262 24/129 R |
| 6,440,339 | B1 | 8/2002 | Magidson et al. | |
| 6,560,829 | B1 * | 5/2003 | Chen | A44B 19/262 24/429 |
| 7,043,842 | B1 | 5/2006 | Moeller et al. | |
| 7,047,602 | B2 | 5/2006 | Wang | |
| 7,264,287 | B2 | 9/2007 | Ching | |
| 7,360,806 | B2 | 4/2008 | Ching | |
| 7,472,933 | B2 * | 1/2009 | Weedon | G09F 3/0358 292/307 A |
| 8,910,351 | B2 | 12/2014 | Iannello et al. | |
| 2004/0148745 | A1 * | 8/2004 | Moeller | A44B 19/262 24/429 |
| 2005/0022347 | A1 | 2/2005 | Yang | |
| 2005/0097712 | A1 * | 5/2005 | Raynor | A44B 19/262 24/429 |
| 2007/0124901 | A1 * | 6/2007 | Cyr | A44B 19/262 24/429 |
| 2009/0265899 | A1 | 10/2009 | Yang | |
| 2013/0104348 | A1 | 5/2013 | Wang | |
| 2016/0007692 | A1 * | 1/2016 | Chen | A44B 19/262 24/429 |
| 2016/0108989 | A1 | 4/2016 | Symons | |
| 2017/0164697 | A1 * | 6/2017 | Chen | A44B 19/262 |

* cited by examiner

ONE-PIECE PULL TAB

BACKGROUND OF THE INVENTION

1. Field of the Invention

The present invention relates to a one-piece pull tab for zippers. In particular, the invention relates to a pull tab that can be applied directly to the zipper head and which is molded in one piece.

2. The Prior Art

Pull tabs for zippers are usually formed by metal plates having an aperture in which the zipper head is mounted. These metal plates are often too small to allow for easy sliding of the zipper. This is especially true when the zipper pull becomes wet and slippery. Therefore, many manufacturers attach a cord having a larger pull on the end to the existing zipper pull. However, these additional cords are often too long to make pulling easy, and the manufacturing process is expensive and time consuming.

U.S. patent application Ser. No. 14/969,094 solves this problem using a one-piece pull tab having a plug and socket configuration connected by a cord. The plug is fitted through the socket in one direction, the cord is wrapped around the plug, and the plug is then inserted back into the socket. The extra width created by the cord wrap prevents the plug from being pulled back through the socket and creates a secure pull tab for attachment to a zipper.

While this configuration is simple to manufacture, it can be complicated to assemble due to the cord being manually wrapped around the plug during assembly.

SUMMARY OF THE INVENTION

It is therefore an object of the invention to provide a zipper pull that can be applied directly to the zipper head, can be customized for a variety of sizes and decorations, and which can be produced and assembled quickly and economically in a single piece.

These and other objects of the invention are accomplished by a pull tab formed by a cord having a cord retaining member attached to one end of the cord and a channel through the interior of the cord retaining member, and a securing device formed by a plug attached to other end of the cord. The plug has a flap secured to a proximal end of the plug via a hinge. Adjacent the cord is a first channel that opens into the proximal end of the cord retaining member and extends partially through the cord retaining member. The channel is sized to allow the plug to pass completely through when the flap is open and extending away from the plug along the cord. On the opposite side of the cord retaining member is a second channel that connects to the first channel to form a continuous straight path through the cord retaining member. The second channel is wider than the width of the plug and has a width that is equal to the width of the plug with the flap closed and secured to it.

In order to secure the device to a zipper, the plug is fed through the loop on the zipper and then through the opening and channels in the cord retaining member, so that the plug extends entirely through the opposite end of the cord retaining member. At this point, the flap on the plug is secured onto the side of the plug via a snap mechanism, increasing the width and circumference of the plug. Finally, the plug with the secured flap is pulled into the second channel by pulling on the looped cord on the proximal end of the cord retaining member. The second channel is sized to be the same size than the circumference of the plug with the flap secured to it. This way, the plug can be pulled back into the cord retaining member and held in the cavity via friction fit. The plug with the flap secured is much too large to fit through the first channel, so the plug cannot be inadvertently disengaged from the cord retaining member.

The first and second channels can be sized based on the size of the plug. For example, the first and second channels could be of relatively equal length, if the plug is approximately half the length of the cord retaining member. The first channel can be made shorter if the plug is longer, or vice versa, so that the plug can be completely accommodated within the second channel inside the cord retaining member.

The cord can be a woven cord, and the cord retaining member and plug are then over-molded onto the woven cord.

The cord retaining member can be formed in any desired shape.

The pull tab of the present invention can be applied directly to a zipper head without the need for a traditional zipper pull. This reduces cost and labor in manufacturing consumer items. The cord could be made to any desired length, depending on the needs of the end user.

The cord retaining member can be equipped with ridges or protrusions or a textured surface, to aid in gripping the pull tab during use.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
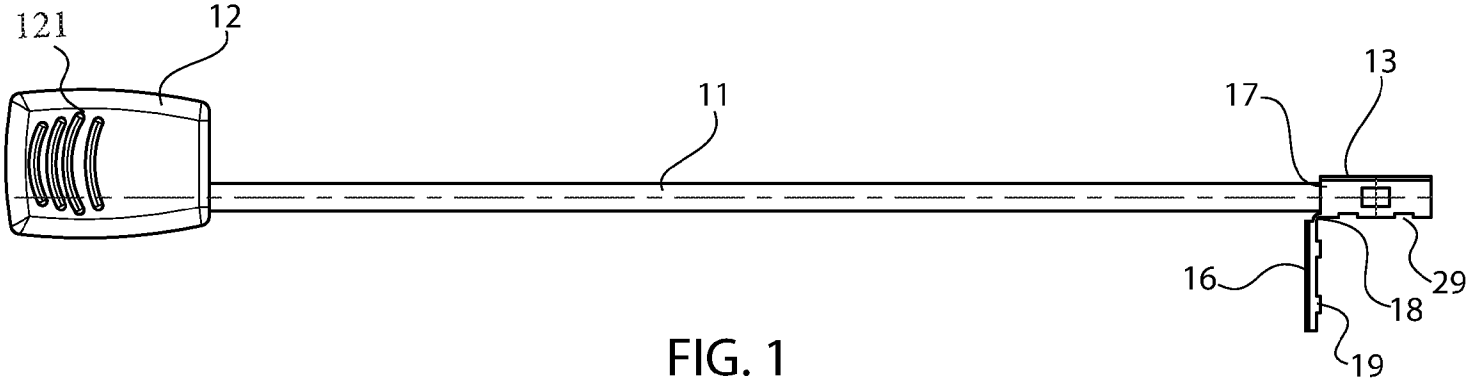
FIG. 1 shows a top view of the pull tab according to the invention.
Figure 2:
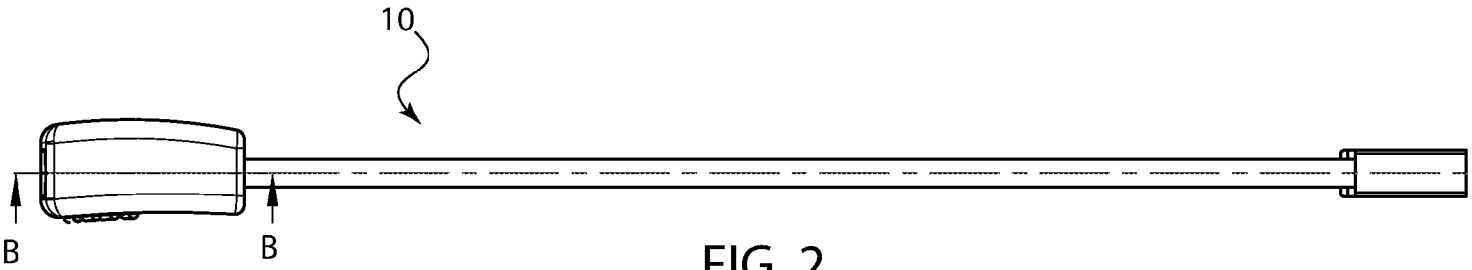
FIG. 2 shows a side view thereof.
Figure 3:
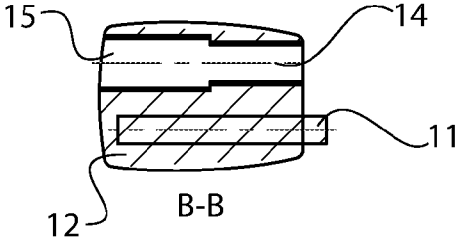
FIG. 3 shows a cross-sectional view along lines B-B of FIG. 2.

Referring now in detail to the drawings and, FIGS. 1 and 2 show a pull tab 10 according to the invention. Pull tab 10 is comprised of a cord 11 having a cord retaining member 12 at one end and a plug 13 at the other end. Cord retaining member 12 and plug 13 are both over molded onto cord 11, which can be a woven or nonwoven cord made of any suitable material. Cord retaining member 12 has a series of ridges 121 for ease of gripping cord retaining member during use. Plug 13 has a flap 16 connected to a distal end 17 via a hinge 18, such as a living hinge. Flap 16 can be secured to plug 13 by folding flap 16 onto plug 13 so that protrusions 19 on flap 16 fit into indentations 29 on plug 13. This fit can be a snap fit where the flap is secured immovably to plug 13, or flap 16 can be simply folded into place.

Cord retaining member 12 has a first channel 14 therein, which opens into the proximal end of the cord retaining member 12, for receiving plug 13 when cord 11 is folded over itself and flap 16 is in an open position extending toward the cord 11. As shown in FIG. 2, a second channel 15 opens into the distal end of plug retaining member 12 and is connected to first channel 14 to form a continuous path through cord retaining member 12. Second channel 15 has a larger width than first channel 14 and can accommodate plug 13 when flap 16 is folded against the side of plug 13. When flap 16 is closed against the side of plug 13, plug 13 becomes wider than channel 14 and cannot fit through channel 14.

Figure 4:
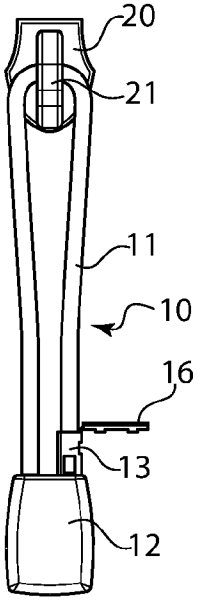
FIGS. 4-9 show the sequence of securing the plug to the cord retaining member around a zipper attachment.
Figure 5:
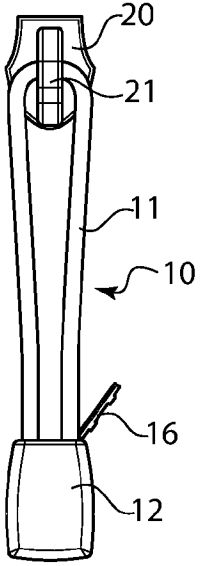
Figure 6:
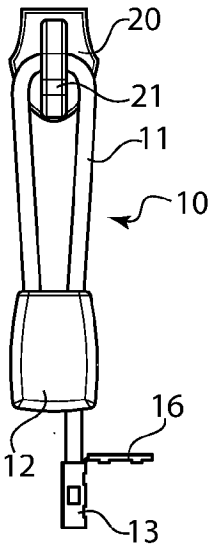
Figure 7:
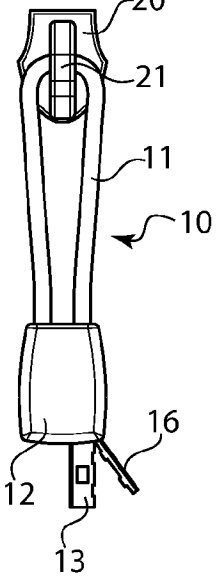
Figure 8:
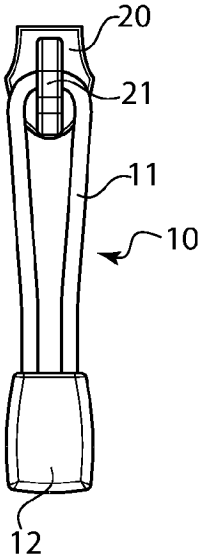
Figure 9:
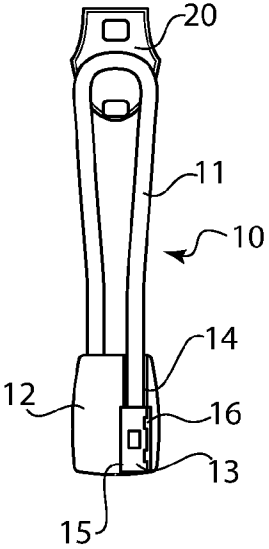

The method of attaching the pull tab 10 to a zipper head is shown in FIGS. 4-9. To attach pull tab 10 to a zipper head 20, plug 13 is first threaded through the loop 21 on zipper head 20 and then into first channel 14, as shown in FIG. 4, with flap 16 extending away from plug 13. Plug 13 is pushed entirely through cord retaining member 12 until it exits channel 15 on the other side, as shown in FIGS. 5-6. Flap 16 can be used to help push plug 13 through cord retaining member 12. Then, flap 16 is folded into the closed position as shown in FIG. 7, thus enlarging the width of plug 13 beyond the width that passed through channels 14 and 15. Finally, as shown in FIG. 8 and in the cross-section of FIG. 9, plug 13 is pulled back entirely within channel 15 of cord retaining member 12. As shown in FIG. 9, plug 13 with flap 16 folded over it is too wide to pass through channel 14, so is securely retained within cord retaining member 12. The only way to disengage plug 13 from cord retaining member 12 would be to push plug 13 out of the distal end of cord retaining member 12, unfold flap 16 and then pull plug 13 back through both channels.

The present invention provides a simple and attractive pull tab that is inexpensive to manufacture and easy to assemble.

Accordingly, while only a single embodiment of the present invention has been shown and described, it is obvious that many changes and modifications may be made thereunto without departing from the spirit and scope of the invention.

What is claimed is:

1. A pull tab comprising:

a cord having a first end and a second end, a cord retaining member having a proximal end attached to the first end of the cord, a distal end, a top surface, a bottom surface, a first channel opening into the proximal end, a second channel opening into the distal end and connecting to the first channel, the second channel being larger in width than the first channel, and a plug attached to the second end of the cord and having a flap connected to the plug, wherein the flap has an open position where the flap is connected to the plug only at one end of the flap, and a closed position where the flap is folded over and extends along a side of the plug, wherein when the flap is in the open position, the plug fits through both the first and second channels, and when the flap is in the closed position, the plug fits within the second channel but does not fit within the first channel, and wherein the pull tab is configured to be assembled by feeding the plug through the first and second channels until the plug extends past the distal end of the cord retaining member, moving the flap to the closed position and pulling the plug back through the second channel until the plug is seated in the second channel.

2. The pull tab according to claim 1, wherein the cord is a woven cord and the cord retaining member and plug are molded onto the woven cord.

3. The pull tab according to claim 1, wherein the flap is configured to be releasably snapped onto the side of the plug.

4. The pull tab according to claim 1, wherein the flap is connected to a proximal end of the plug via a living hinge.

5. The pull tab according to claim 1, wherein the cord retaining member contains a plurality of ridges or protrusions on the top surface.

6. A method for assembling a pull tab having a cord having a first end and a second end, a cord retaining member having a proximal end attached to the first end of the cord, a distal end, a top surface, a bottom surface, a first channel opening into the proximal end, a second channel opening into the distal end and connecting to the first channel, the second channel being larger in width than the first channel, and a plug attached to the second end of the cord and having a flap connected to the plug, wherein the flap has an open position where the flap is connected to the plug only at one end of the flap, and a closed position where the flap is folded over and extends along a side of the plug, wherein when the flap is in the open position, the plug fits through both the first and second channels, and when the flap is in the closed position, the plug fits within the second channel but does not fit within the first channel, the method comprising the following steps:

feeding the plug through the first and second channels so that the plug extends through the distal end of the cord retaining member, moving the flap to the closed position; and pulling the cord back through the first and second channels until the plug is seated within the second channel.

* * * * *